US007157725B2

(12) United States Patent
Kawamura et al.

(10) Patent No.: US 7,157,725 B2
(45) Date of Patent: Jan. 2, 2007

(54) DISCRIMINATION DEVICE FOR TYPES OR CONFIGURATIONS OF DISCRIMINATION SUBJECTS

(75) Inventors: Yoshinori Kawamura, Kanagawa (JP); Manabu Mizumoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 11/067,892

(22) Filed: Mar. 1, 2005

(65) Prior Publication Data

US 2005/0189504 A1 Sep. 1, 2005

(30) Foreign Application Priority Data

Mar. 1, 2004 (JP) ..... 2004-056153

(51) Int. Cl.
*G01N 21/86* (2006.01)
*G01V 8/00* (2006.01)

(52) U.S. Cl. ..... 250/559.16; 250/559.18; 356/445; 347/106

(58) Field of Classification Search ..... 250/559.01, 250/559.39, 559.4, 559.16, 559.17, 559.18; 356/445–448; 271/3.15; 347/19, 106
See application file for complete search history.

(56) References Cited

U.S. PATENT DOCUMENTS 6,600,167 B1 * 7/2003 Sano ..... 250/559.11
6,825,484 B1 * 11/2004 Burkatovsky ..... 250/559.18
2001/0022425 A1 9/2001 Toyofuku

FOREIGN PATENT DOCUMENTS

| | | |
|---|---|---|
| EP | 1 136 403 A1 | 9/2001 |
| JP | 2-81846 A | 3/1990 |
| JP | 7-25516 A | 1/1995 |
| JP | 2001-247254 A | 9/2001 |

* cited by examiner

*Primary Examiner*—Stephone B. Allen
*Assistant Examiner*—Patrick J. Lee
(74) *Attorney, Agent, or Firm*—Sughrue Mion, PLLC

(57) ABSTRACT

A discrimination device which is disposed on a conveyance path of conveyed items, such as planographic printing plates, slip sheets and the like. The discrimination device is structured with a first sensor, which detects presence or absence of the conveyed items, and second and third sensors, which identify types of the conveyed items. The first sensor can judge presence or absence of a conveyed item from whether or not irradiated light is reflected by a conveyed item. The second and third sensors discriminate between the types—the planographic printing plates and the slip sheets—by the intensity of reflected light, on the basis of a difference in surface reflectivities of the conveyed items. With these three optical sensors, it is possible to reliably identify four conveyance configurations of the conveyed items.

22 Claims, 11 Drawing Sheets

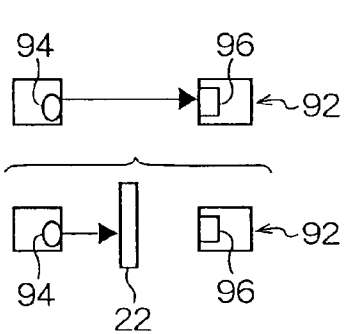
FIG. 6F
FIG. 6G
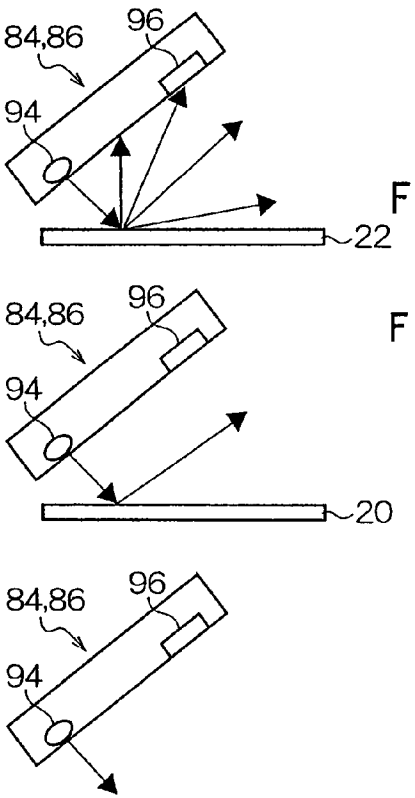
FIG. 6C
FIG. 6D
FIG. 6E
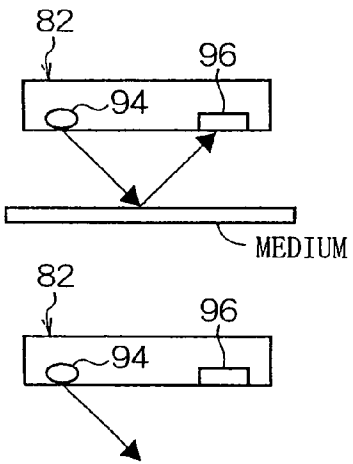
FIG.6A
FIG.6B

DISCRIMINATION DEVICE FOR TYPES OR CONFIGURATIONS OF DISCRIMINATION SUBJECTS

CROSS-REFERENCE TO RELATED APPLICATION

This application claims priority under 35 USC 119 from Japanese Patent Application No. 2004-56153, the disclosure of which is incorporated by reference herein.

BACKGROUND OF THE INVENTION

1. Field of the Invention

The present invention relates to a discrimination device, and more specifically relates to a discrimination device which discriminates between two kinds of discrimination objects by utilizing light reflected therefrom or transmitted therethrough. The present invention is suitably applied to, for example, a discrimination device for identifying any of four possible discrimination objects, which are combinations structured by a planographic printing plate and/or a slip sheet.

2. Description of the Related Art

As an example of a conventional discrimination device, a discrimination device for discriminating between a planographic printing plate and a slip sheet, which protects a photosensitive surface of the planographic printing plate, will be described.

Commonly, a slip sheet for protection is closely adhered to an image recording surface of a planographic printing plate, and these are often plurally stacked in a thickness direction to structure a plate sheaf of the planographic printing plates. Hence, in a case of image-recording at the planographic printing plate by an optical exposure device or the like, it is necessary to extract the planographic printing plates and slip sheets from the plate sheaf one at a time and supply the planographic printing plates to the optical exposure device. Regarding material that has been extracted, there are three cases: a state in which a slip sheet is adhered to a planographic printing plate, a planographic printing plate alone, and a slip sheet alone. There is also a state in which nothing has been extracted. Accordingly, it is preferable to be able to reliably discriminate between these four states, with a simple structure.

For example, Japanese Patent Application (JP-A) No. 2001-247254 describes a discrimination device in which a pair of optical sensors is disposed upward of alternately stacked photopolymer plates and slip sheets. A sensing level of one of these optical sensors is set lower than the other optical sensor. Consequently, with light reflected from a photopolymer plate, both the optical sensors are turned on, but with light reflected from a slip sheet, the one optical sensor is turned off. Thus, it is possible to discriminate between the photopolymer plates and the slip sheets.

However, with this discrimination device, it is only possible to easily discriminate whether a material that is disposed at the top of a stack is a photopolymer plate or a slip sheet, and it is not possible to discriminate between the four states mentioned above.

SUMMARY OF THE INVENTION

In consideration of the circumstances described above, the present invention provides a discrimination device which is capable, with a simple structure, of reliably discriminating between four states structured by two types of discrimination subject, which differ in surface reflectivity.

A first aspect of the present invention is a discrimination device for discriminating a type, from two types which differ in surface reflectivity, of a discrimination subject, the discrimination device comprising: a first optical sensor, the output of which switches to one of an ON state and an OFF state in accordance with presence of at least one of the two types of discrimination subject; a second optical sensor including a light detection portion which receives light reflected by the two types of discrimination subject, the output of the second optical sensor switching to one of an ON state and an OFF state in accordance with light reflected from, of the two types of discrimination subject, the type whose reflectivity is higher; and a third optical sensor including a light detection portion which receives light reflected by the two types of discrimination subject, the output of the third optical sensor switching to one of an ON state and an OFF state in accordance with light reflected from, of the two types of discrimination subject, the type whose reflectivity is lower.

That is, in this discrimination device, if either of the discrimination subjects is present, the first optical sensor switches to the ON state or the OFF state accordingly, and that presence can be sensed.

In a case in which a discrimination subject includes the high-reflectivity subject, the second optical sensor is switched to the ON state or OFF state thereof by light reflected from this high-reflectivity subject, and the presence of the high-reflectivity subject can be sensed. Further, in a case in which a discrimination subject includes the low-reflectivity subject, the third optical sensor is switched to the ON state or OFF state thereof by light reflected from this low-reflectivity subject, and the presence of the low-reflectivity subject can be sensed. Hence, it is possible to discriminate, from combinations of the ON states and OFF states of the second and third sensors, a state in which both the high-reflectivity subject and the low-reflectivity subject are present, and states in which only one of these two subjects is present.

Thus, with the present invention, it is possible to reliably discriminate between four states of a discrimination subject, with a simple structure which is only provided with three optical sensors.

In the invention of the aspect described above, the first optical sensor may include a light emission portion, which emits light to the discrimination subject, and a reflected light detection portion, on which reflected light that has been emitted by the light emission portion and reflected at a surface of the discrimination subject is incident.

In the above structure, the first optical sensor includes the light emission portion, there is no need to additionally provide a light emission portion, and structure can be made simpler.

Furthermore, because the reflected light detection portion, at which the reflected light that has been emitted by the light emission portion and reflected at the surface of the discrimination subject is incident, is provided at the first optical sensor, there is no need to perform positioning and the like of a reflected light detection portion.

Further, in the invention of the aspect described above, at least one of the second optical sensor and the third optical sensor may include a light emission portion, which emits light to the discrimination subject, and a scattered light detection portion, on which some of scattered light that has been emitted by the light emission portion and scattered at a surface of the discrimination subject is incident.

In the above structure, one or both of the second optical sensor and the third optical sensor includes the light emission portion(s), there is no need to additionally provide a light emission portion, and structure can be made simpler.

Furthermore, because the scattered light detection portion, at which the scattered light that has been emitted by the light emission portion and scattered at the surface of the discrimination subject is incident, is provided at the second/third optical sensor, there is no need to perform positioning and the like of a scattered light detection portion.

Herein, as the second optical sensor and the third optical sensor, sensors which have, for example, the same structure as the first optical sensor may be employed. The second optical sensor and third optical sensor may be structured to be arranged at predetermined angles, such that reflected light from the discrimination subject is not directly incident thereon, or the like. Because sensors with the same structures can be employed as the optical sensors, costs can be lowered.

Further again, in the invention of the aspect described above, it is possible that the discrimination subject is structured by at least one of a planographic printing plate and a slip sheet which has been superposed with the planographic printing plate, the first optical sensor switches to the one of the ON state and the OFF state thereof in accordance with presence of either of the planographic printing plate and the slip sheet, the second optical sensor switches to the one of the ON state and the OFF state thereof in accordance with light reflected from the planographic printing plate, and the third optical sensor switches to the one of the ON state and the OFF state thereof in accordance with light reflected from the slip sheet.

Ordinarily, planographic printing plates and slip sheets are subject to completely different processings subsequent to, for example, separation thereof. Therefore, it is necessary that planographic printing plates and slip sheets are reliably separated and conveyed to different processing stages. With the discrimination device described above, it is possible to reliably discriminate between the four states structured by the planographic printing plates and slip sheets. Hence, it is possible to easily and reliably implement subsequent separation, conveyance, etc.

In such a case, the light emission portion(s) of the at least one of the second optical sensor and the third optical sensor may be capable of emitting light with a wavelength from 570 nm to 740 nm.

When light in this wavelength range is employed, a difference in light absorbance (light absorptivity) between the planographic printing plates and the slip sheets will be larger, and it will be possible to discriminate more easily and reliably.

A second aspect of the present invention is a discrimination device for discriminating a type and configuration of a subject, the discrimination device comprising: a first optical sensor, an output state of which switches in accordance with presence or absence of the subject; a second optical sensor including a light detection portion which receives light reflected from the subject, an output state of the second sensor switching in accordance with the light reflected from the subject if reflectivity of the subject is relatively high; and a third optical sensor including a light detection portion which receives light reflected from the subject, an output state of the third sensor switching in accordance with the light reflected from the subject if reflectivity of the subject is relatively low, wherein the type and configuration of the subject is discriminated on the basis of the output states of the first, second and third sensors.

A third aspect of the present invention is a discrimination device for discriminating a conveyance configuration of a sheet which is conveyed along a path, the discrimination device comprising: a first sensor, an output state of which switches in accordance with presence or absence of the sheet in the path; a second sensor disposed at a side of one face of the sheet that is conveyed along the path, the second sensor including a light detection portion which receives light reflected from the sheet, and an output state of the second sensor switching in accordance with the light reflected from the sheet if reflectivity of the sheet is relatively high; and a third sensor disposed at a side of another face of the sheet that is conveyed along the path, the third sensor including a light detection portion which receives light reflected from the sheet, and an output state of the third sensor switching in accordance with the light reflected from the sheet if reflectivity of the sheet is relatively low, wherein the conveyance configuration of the sheet is discriminated on the basis of the output states of the first, second and third sensors.

When the present invention is structured as described above, it is possible to reliably discriminate, with a simple structure, between the four states that are structured by the two types of discrimination subject differing in surface reflectivity.

BRIEF DESCRIPTION OF THE DRAWINGS

FIG. 4A is a case of joint feeding, FIG. 4B is a case of individual feeding, and FIG. 4C is a case of multiple joint feeding.

FIG. 5A shows joint feeding, FIG. 5B shows absence of a conveyed medium, FIG. 5C shows individual feeding of a slip sheet, and FIG. 5D shows individual feeding of a planographic printing plate.

FIGS. 6A to 6G are explanatory views showing operation of each of sensors structuring the discrimination device of the present invention. FIGS. 6A and 6B show a presence/absence sensor, FIGS. 6C, 6D and 6E show a discrimination sensor, and FIGS. 6F and 6G show a slip sheet detection sensor.

DETAILED DESCRIPTION OF THE INVENTION

Figure 1:
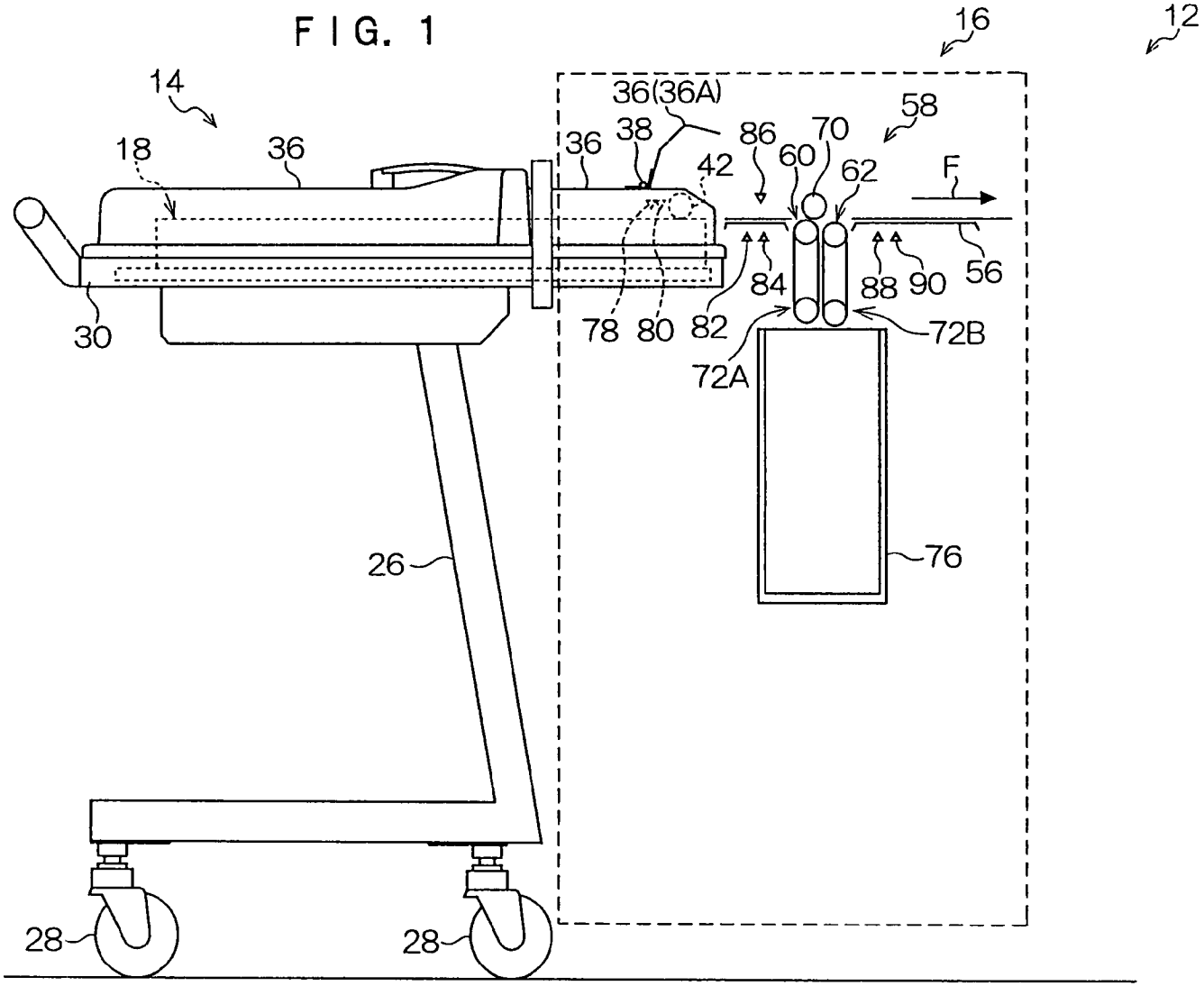
FIG. 1 is a side view showing a planographic printing plate supply apparatus of a first embodiment of the present invention.
Figure 2:
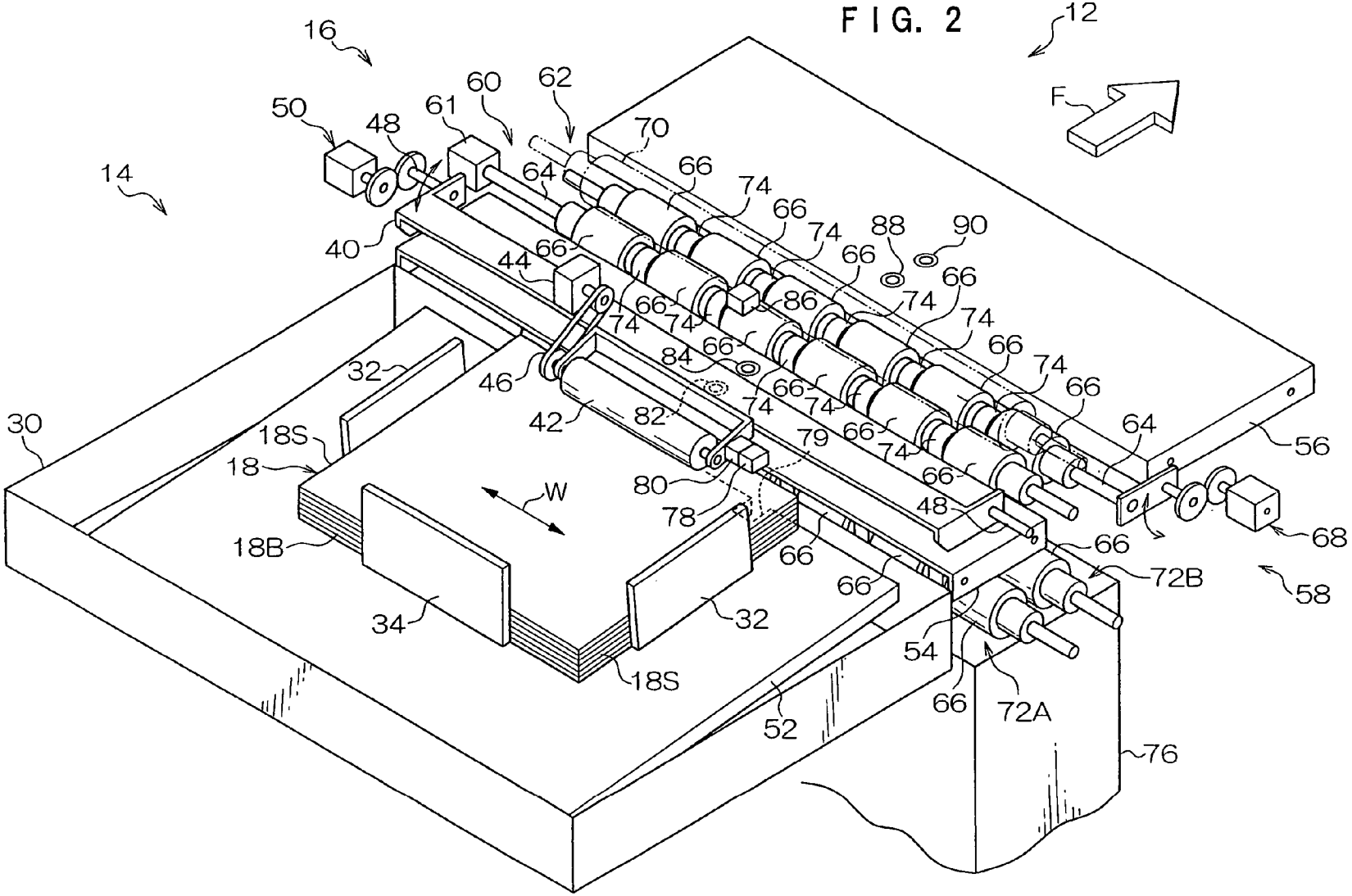
FIG. 2 is a perspective view showing a loading section and a feeding section of the planographic printing plate supply apparatus of the first embodiment of the present invention.

FIG. 1 shows general structure of a planographic printing plate supply apparatus 12 of a first embodiment of the present invention. FIG. 2 shows a loading section 14 and a feeding section 16 of this planographic printing plate supply apparatus 12, in a state in which a plate sheaf 18 is loaded at the loading section 14.

Figures 4A, 4B, 4C:
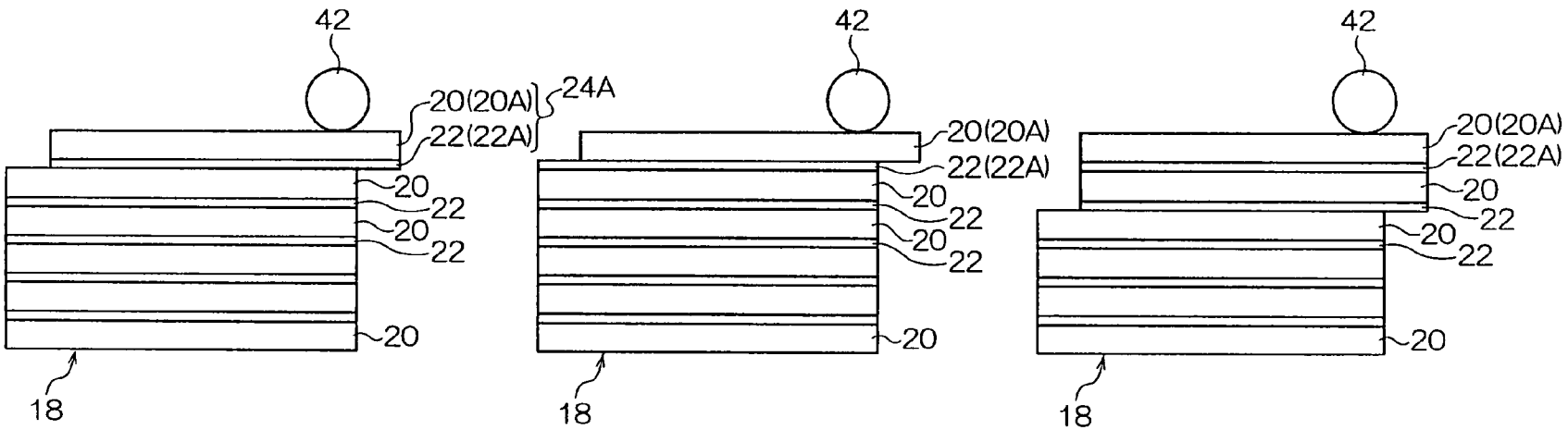
FIGS. 4A, 4B and 4C are explanatory views describing configurations of combinations of discrimination subjects during feeding of planographic printing plates at the planographic printing plate supply apparatus.

At a planographic printing plate 20, a photosensitive agent is coated onto one face of a support body, which is formed in a plate shape of aluminium or the like, to structure a photosensitive agent surface. As shown in FIGS. 4A to 4C, slip sheets 22, which protect the photosensitive agent surfaces, are stacked alternately with planographic printing plates 20 to structure the plate sheaf 18. In the states shown in FIGS. 4A to 4C, the planographic printing plates 20 and slip sheets 22 are stacked such that the photosensitive agent surfaces face upward, and the slip sheet 22 that protects the photosensitive agent surface of the topmost planographic printing plate 20 has already been removed. Herebelow, a combination structured by one of the planographic printing plates 20 with the slip sheet 22 that is at the lower side thereof in this state is a unit of conveyance in 'joint feeding' (in other words, unit feeding), which is described later, and is accordingly referred to as a layer combination 24.

Figure 5A:
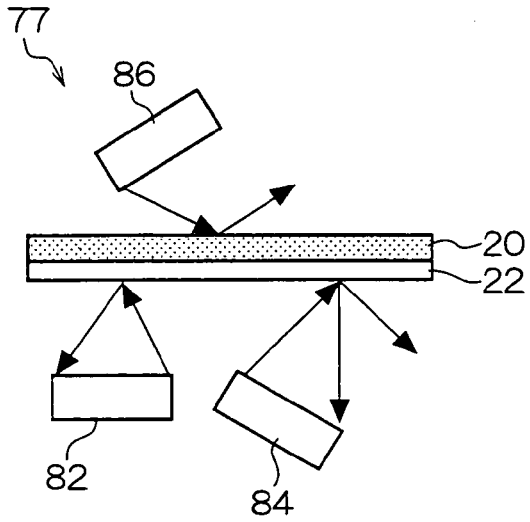
FIGS. 5A, 5B, 5C and 5D are explanatory views showing conditions for discriminating between combination configurations of conveyed mediums at a discrimination device of an embodiment of the present invention.
Figure 5B:
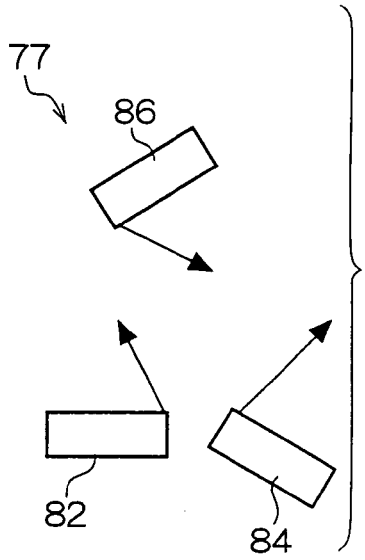
Figure 5C:
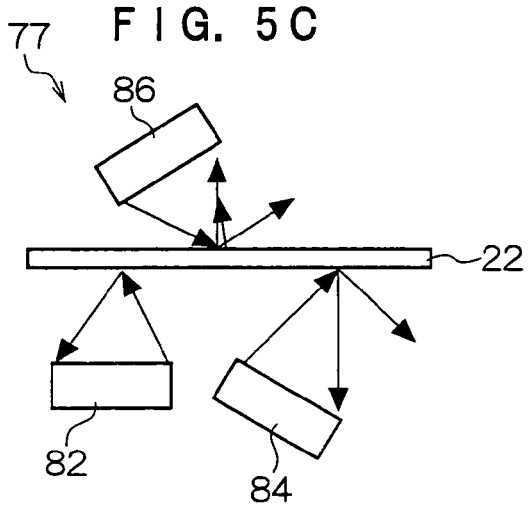
Figure 5D:
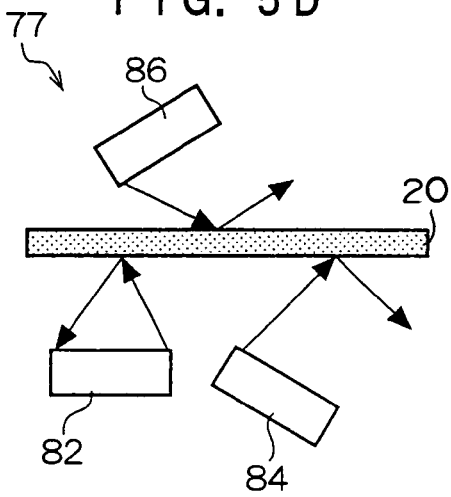

FIGS. 4A to 4C show three conveyance configurations of the planographic printing plates 20 and slip sheets 22 being taken out from the planographic printing plate supply apparatus 12. FIG. 4A is a conveyance configuration in which a topmost layer combination 24A, which is to say a topmost planographic printing plate 20A and a slip sheet 22A at the lower side thereof, are being taken out from the plate sheaf 18 as a single combination, which is below referred to as joint feeding. (Hereafter, the planographic printing plates 20 and slip sheets 22 are referred to in general as conveyed mediums). FIG. 4B is a conveyance configuration in which only a single planographic printing plate 20 is being taken out while no slip sheet 22 is being taken out, and is below referred to as 'individual feeding'. Note that individual feeding includes a conveyance configuration in which one of the slip sheets 22 is being taken out alone, in a case in which that slip sheet 22 was in the topmost position. The state shown in FIG. 4C is a conveyance configuration in which a plurality of the layer combinations 24 mentioned above are being taken out in a superposed state, and is below referred to as 'multiple joint feeding'. In the present embodiment, multiple joint feeding is prevented by adjustment of a load W that is applied to the plate sheaf 18 from a pick-up roller 42, which is described later, and, at least, consistent joint feeding is enabled (preferably, arbitrary switching between joint feeding and individual feeding is possible). Consequently, as shown in FIGS. 5A to 5D, there are four conveyance combinations in the present embodiment: joint feeding (FIG. 5A), absence of a conveyed medium (FIG. 5B), individual conveyance of the slip sheet 22 alone (FIG. 5C) and individual conveyance of the planographic printing plate 20 alone (FIG. 5D). Hereafter, a direction of feeding of the planographic printing plate 20 is represented by an arrow F and a direction intersecting therewith (a width direction of the planographic printing plate 20) is represented by an arrow W.

The planographic printing plate supply apparatus 12 is provided with a table portion 26. The loading section 14 and the feeding section 16 are disposed on this table portion 26. Castors 28 are fitted to the table portion 26. The castors 28 enable movement of the planographic printing plate supply apparatus 12 as a whole, to associate/dissociate the planographic printing plate supply apparatus 12 with, for example, a planographic printing plate insertion portion of an exposure device or the like.

As shown in FIG. 2, the loading section 14 includes a level, rectangular loading tray 30. Two side end guide plates 32 and one rear end guide plate 34 are disposed in the loading tray 30. The side end guide plates 32 are slid in the the directions of arrow W by an unillustrated sliding mechanism to match the size of the planographic printing plates 20, and regulate positions of side faces of the plate sheaf 18, that is, of a plurality of the layer combinations 24. Similarly, the rear end guide plate 34 is slid in the direction of arrow F (and a direction opposite thereto) by an unillustrated sliding mechanism and regulates the position of a rear end of the plate sheaf 18 (i.e., of the plurality of layer combinations 24).

The loading section 14 is provided with a number of covers 36 such that a region at which the plate sheaf 18 is loaded is covered. A cover 36A covers a conveyance direction downstream side end portion of the plate sheaf 18. When the planographic printing plate supply apparatus 12 is installed at an exposure device or the like, the cover 36A is pushed upward by an unillustrated pushing member and, as shown in FIG. 1, the cover 36A rotates about a hinge 38 and is flipped up.

Upward of (diagonally above) the loading section 14, a holder 40 spans across along the width direction of the planographic printing plate 20. The pick-up roller 42 is rotatably mounted at the holder 40 so as to be disposed above the plate sheaf 18 that has been loaded in the loading section 14. Driving force from a driving motor 44 operates the pick-up roller 42 via an endless belt 46, and the pick-up roller 42 rotates (forward-rotates) in a direction for conveying conveyed mediums, that is, the planographic printing plates 20 and the slip sheets 22.

The holder 40 is structured to be rotatable about support shafts 48, which are provided at both width direction ends of the holder 40, at the conveyance direction downstream side thereof. By rotary driving force from a drive unit 50 which is provided sideward of the holder 40, the pick-up roller 42 is rotated between a conveyance position, at which the pick-up roller 42 contacts the plate sheaf 18 and applies a predetermined load W thereto, and a withdrawn position, at which the pick-up roller 42 is separated from the plate sheaf 18.

A bottom portion of the loading tray 30 is structured with a loading plate 52, which swings on an unillustrated hinge provided at the conveyance direction upstream side thereof. In the state in which the plate sheaf 18 is placed on the loading plate 52, the loading plate 52 is urged upward by an unillustrated urging member and the topmost planographic printing plate 20 (or slip sheet 22) is assuredly contacted with the pick-up roller 42.

Two guide plates 54 and 56, which are spaced apart by a predetermined gap in the conveyance direction, are disposed downstream in the conveyance direction relative to the loading section 14. The planographic printing plate 20 is supported by these guide plates 54 and 56 while being conveyed.

A slip sheet separation apparatus 58 is disposed between the guide plates 54 and 56. The slip sheet separation apparatus 58 includes a conveyance roller unit 60 and a retarding roller unit 62, which are arranged in that order in the conveyance direction. Each of the conveyance roller unit 60 and the retarding roller unit 62 is structured by a rotatable shaft 64, which spans across along the width direction, and a plurality of rubber rollers 66, which are fixed to the shaft 64 and spaced by predetermined intervals. When the conveyance roller unit 60 and retarding roller unit 62 are subjected to driving force from a drive motor 61 and rotated, the rubber rollers 66 of the conveyance roller unit 60 rotate in the direction of arrow R1 (forward-rotate) and the rubber rollers 66 of the retarding roller unit 62 rotate in a direction opposite to the arrow R1 (reverse-rotate).

Figure 3:
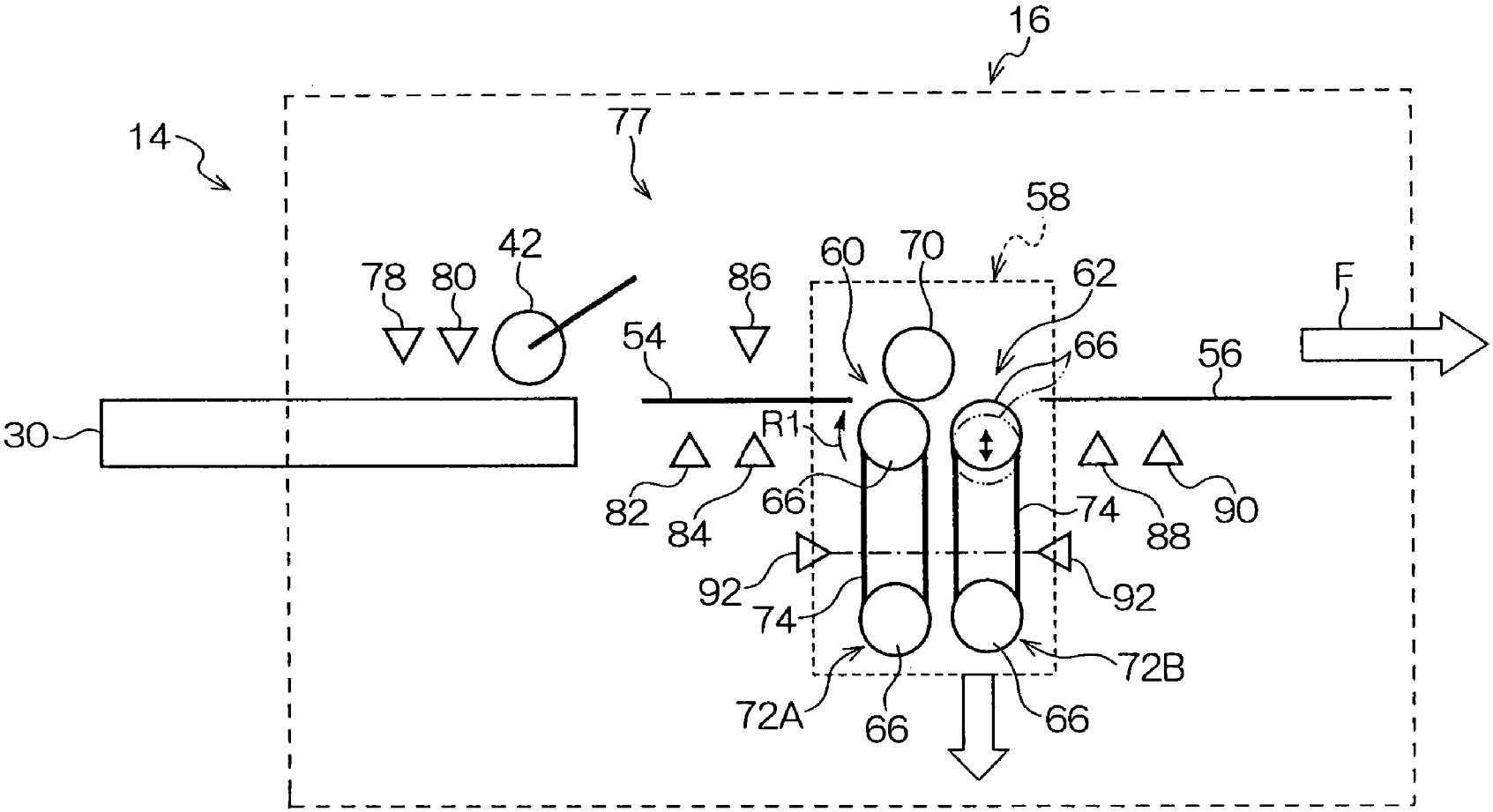
FIG. 3 is a schematic elevational view showing the loading section and feeding section of the planographic printing plate supply apparatus of the first embodiment of the present invention.

The retarding roller unit 62 is moved (raised and lowered), by a drive unit 68 provided at one end side thereof, between a contacting position for contacting the slip sheet 22 during conveyance (the position shown by solid lines in FIG. 3) and a withdrawn position which is spaced apart from the slip sheet 22 (the position shown by broken lines in FIG. 3). At the contacting position, when the retarding roller unit 62 reverse-rotates in a state of contact with the slip sheet 22, the slip sheet 22 can be separated from the planographic printing plate 20. The rubber rollers 66 of the retarding roller unit 62 contact with the rubber rollers 66 of the conveyance roller unit 60 such that the slip sheet 22 can be nipped between the rubber rollers 66 of the retarding roller unit 62 and the rubber rollers 66 of the conveyance roller unit 60.

Upward of the conveyance roller unit 60, a nipping roller 70 rotatably spans across along the width direction. The nipping roller 70 is caused to contact with the rubber rollers 66 of the conveyance roller unit 60 by the weight of the nipping roller 70, to enable nipping of the planographic printing plate 20 and slip sheet 22 between the nipping roller 70 and the rubber rollers 66 of the conveyance roller unit 60. In this nipping state, when the rubber rollers 66 of the conveyance roller unit 60 rotate in the direction of arrow R1, the planographic printing plate 20 and slip sheet 22 are conveyed in the direction of arrow F. Here, as can be seen in FIG. 3, there is a gap between the nipping roller 70 and the rubber rollers 66 of the retarding roller unit 62, of a size such that the planographic printing plate 20 and slit sheet 22 are not nipped therebetween.

Slip sheet conveyance roller units 72A and 72B are disposed below the conveyance roller unit 60 and the retarding roller unit 62, respectively. Similarly to the conveyance roller unit 60 and the retarding roller unit 62, both the conveyance roller units 72A and 72B are structured by others of the shafts 64 and rubber rollers 66, and are capable of nipping the slip sheet 22 therebetween. Endless driving belts 74 are wound round the shaft 64 of the conveyance roller unit 60 and the shaft 64 of the conveyance roller unit 72A, and the conveyance roller unit 72A rotates at the same times and in the same direction as the conveyance roller unit 60. Similarly, others of the driving belts 74 are wound round the shaft 64 of the retarding roller unit 62 and the shaft 64 of the conveyance roller unit 72B. Thus, in the state in which the slip sheet 22 is nipped, the nipped slip sheet 22 can be conveyed downward by the rubber rollers 66 of the conveyance roller units 72A and 72B rotating. At such a time, the slip sheet 22 is guided by the driving belts 74.

As shown in FIG. 2, a collection box 76 is provided below the conveyance roller units 72A and 72B to collect the slip sheets 22.

As shown in FIGS. 2 and 3, a presence/absence sensor 78 and a discrimination sensor 80 are mounted at the holder 40, at the conveyance direction upstream side relative to the pick-up roller 42. Further, a presence/absence sensor 82 and a discrimination sensor 84 are arranged at the guide plate 54 in that order from the upstream side thereof. Upward of the presence/absence sensor 82 and discrimination sensor 84, a discrimination sensor 86 is retained by an unillustrated retention member. Further yet, a presence/absence sensor 88 and a discrimination sensor 90 are provided at the guide plate 56 in that order from the upstream side thereof. These presence/absence sensors 78, 82 and 88 detect the presence or absence of a conveyed medium (the planographic printing plate 20 and/or the slip sheet 22), and the discrimination sensors 80, 84, 86 and 90 identify whether the conveyed medium is the planographic printing plate 20 or the slip sheet 22.

A notch 79 is formed in the loading plate 52 of the loading tray 30 to correspond with the presence/absence sensor 78. When the plate sheaf 18 (the planographic printing plates 20 and slip sheets 22) has been placed on the loading plate 52, light from the presence/absence sensor 78 is reflected by the planographic printing plate 20, and this reflected light is detected. If the plate sheaf 18 has not been loaded, the light from the presence/absence sensor 78 passes through the notch 79. Thus, the presence or absence of the plate sheaf 18 can be detected.

Herein, the presence/absence sensor 82 and the discrimination sensors 84 and 86 structure a discrimination device 77 of the present invention. Below, these sensors structuring the discrimination device 77 are discussed in detail with reference to table 1 and FIGS. 5A to 5D and 6A to 6G.

TABLE 1

| Type of conveyed medium | Planographic printing plate | Slip sheet | Planographic printing plate + slip sheet | No conveyed medium |
|---|---|---|---|---|
| Presence/absence sensor 82 | ON | ON | ON | OFF |
| Discrimination sensor 86 | OFF | ON | OFF | OFF |
| Discrimination sensor 84 | OFF | ON | ON | OFF |

As shown in FIGS. 6A and 6B, the presence/absence sensor 82 is structured by a light reflection-type sensor featuring a light emission portion 94 and a light detection portion 96. Light is irradiated from the light emission portion 94 and, if this light is reflected by the planographic printing plate 20 or slip sheet 22, which is a discrimination subject, and received by the light detection portion 96 (see FIG. 6A), it is judged that a conveyed medium is present. If the light is not received by the light detection portion 96 (see FIG. 6B), it is judged that the conveyed medium is absent. Note that the illustrations of the presence/absence sensor 82 and the discrimination sensor 84 in FIGS. 6A to 6E are inverted in the vertical direction.

Similarly to the presence/absence sensor 82, the discrimination sensors 84 and 86 include others of the light emission portion 94 and light detection portion 96. However, as shown in FIGS. 6C, 6D and 6E, the discrimination sensors 84 and 86 are disposed to be inclined relative to the conveyed medium.

The discrimination sensor 84 irradiates light to a rear face side of the planographic printing plate 20 and discriminates between the planographic printing plates 20 and the slip sheets 22 by intensities of reflected light, in accordance with a difference between surface reflectivities thereof. That is, in a case in which the slip sheet 22 is applied to the rear face of the planographic printing plate 20 (joint feeding) or a case of individual feeding of the slip sheet 22, the surface reflectivity of the slip sheet 22 is low and light is scattered by the slip sheet 22, as shown in FIG. 6C. Because some of this scattered light is incident at the light detection portion 96, it can be detected that the slip sheet 22 is present. On the other hand, in a case in which the slip sheet 22 is not applied to the rear face of the planographic printing plate 20 (individual feeding of the planographic printing plate 20), because reflectivity of the planographic printing plate 20 is relatively higher, the light is reflected without being scattered. Hence, the discrimination sensor 84 is arranged such that the light reflected at the rear face is not incident at the light detection portion 96, as shown in FIG. 6D, and it can thus be detected that the planographic printing plate 20 is present. Note that this discrimination sensor 86 can be structured simply by arranging a sensor the same as the presence/absence sensor 82 to be inclined relative to the conveyed mediums.

In contrast, as is described below, the discrimination sensor 86 utilizes a difference between absorbances of the planographic printing plates 20 and the slip sheets 22 to identify whether the conveyed medium is the planographic printing plate 20 or the slip sheet 22.

Figure 7:
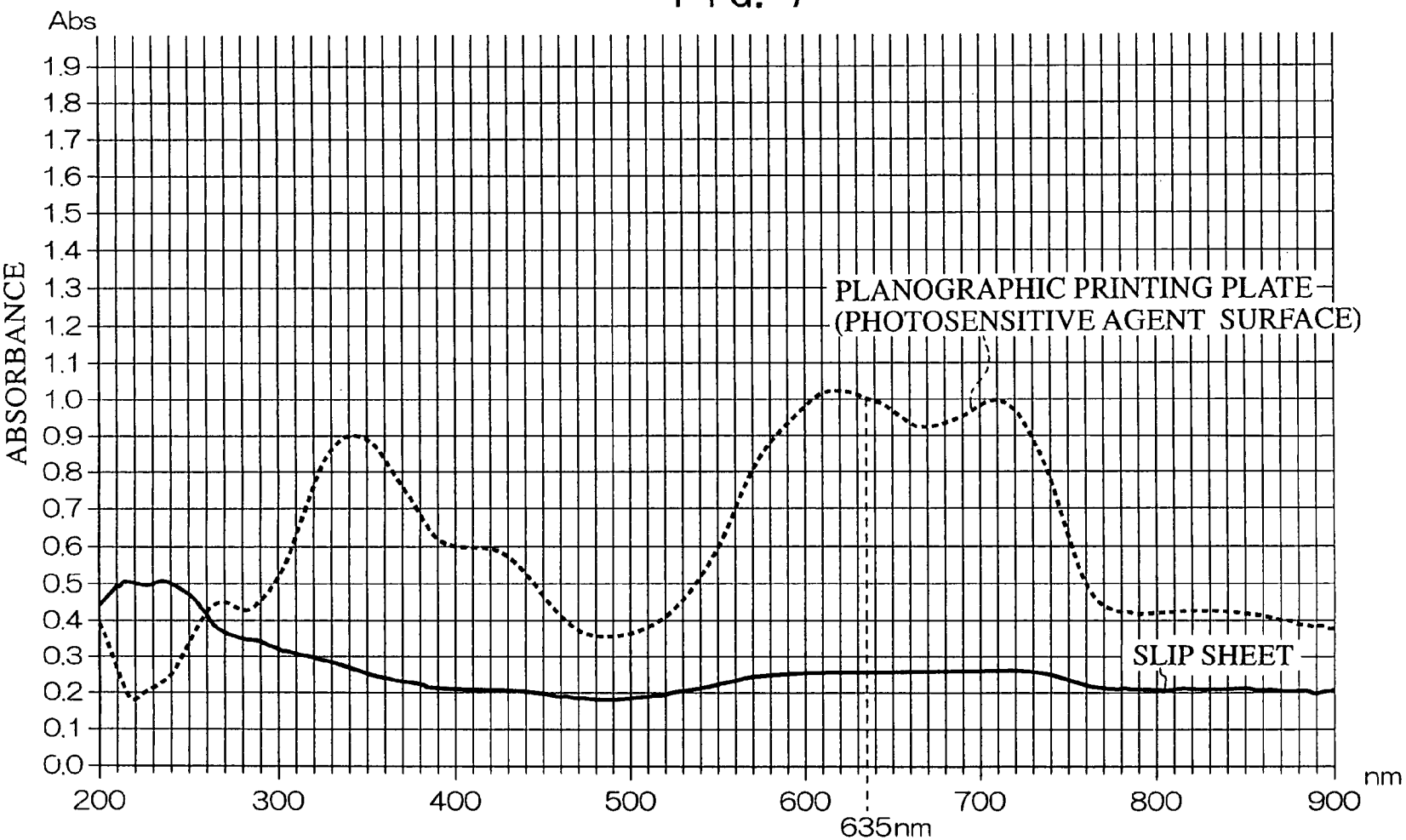
FIG. 7 is a graph showing relationships between wavelength and absorbance for a photosensitive agent surface of a planographic printing plate and for a slip sheet.

FIG. 7 shows an example of a difference between absorbance of the photosensitive agent surface of the planographic printing plate 20 and absorbance of the slip sheet 22. As can be seen from this graph, with light of wavelengths in a range of 570 to 740 nm, absorbance of the photosensitive agent surface is large but absorbance of the slip sheet 22 is not large, and a difference between these absorbances is large. Therefore, it is preferable to employ wavelengths in the range of 570 to 740 nm. When light of such wavelengths is irradiated at the conveyed mediums, it is possible, on the basis of the difference in absorbances, to discriminate between cases in which the conveyed mediums include the planographic printing plates 20 (joint feeding and individual feeding of the planographic printing plates 20), and cases of individual feeding of the slip sheet 22.

A slip sheet detection sensor 92 is disposed between the conveyance roller units 72A and 72B, and the respectively corresponding conveyance roller unit 60 and retarding roller unit 62. The slip sheet detection sensor 92 can detect passage of the slip sheet 22. As shown in FIGS. 6F and 6G, this slip sheet detection sensor 92 is structured by a light transmission-type sensor which is equipped with another of the light emission portion 94 and another of the light detection portion 96, as a pair which are disposed to face one another. When the slip sheet 22 is present between the light emission portion 94 and the light detection portion 96, light from the light emission portion 94 is obstructed and is not received by the light detection portion 96, and the light detection portion 96 is OFF. When there is nothing between the light emission portion 94 and light detection portion 96, the light detection portion 96 receives the light and is ON.

For the presence/absence sensors 78 and 88, sensors with structures the same as the presence/absence sensor 82 may be employed. For the discrimination sensor 80, a sensor with the same structure as the discrimination sensor 86 may be employed, and for the discrimination sensor 90, a sensor with the same structure as the discrimination sensor 84 may be employed.

Respective attitudes of these sensors are not particularly limited as long as the action required of each sensor (detection or discrimination of the conveyed mediums) is reliably exhibited. However, if the presence/absence sensors 78, 82 and 88 are disposed, for example, with attitudes for which the angle of incidence of light on the conveyed medium is equal to the angle of reflection, reflected light can be detected more reliably, which is preferable.

Figure 8A:
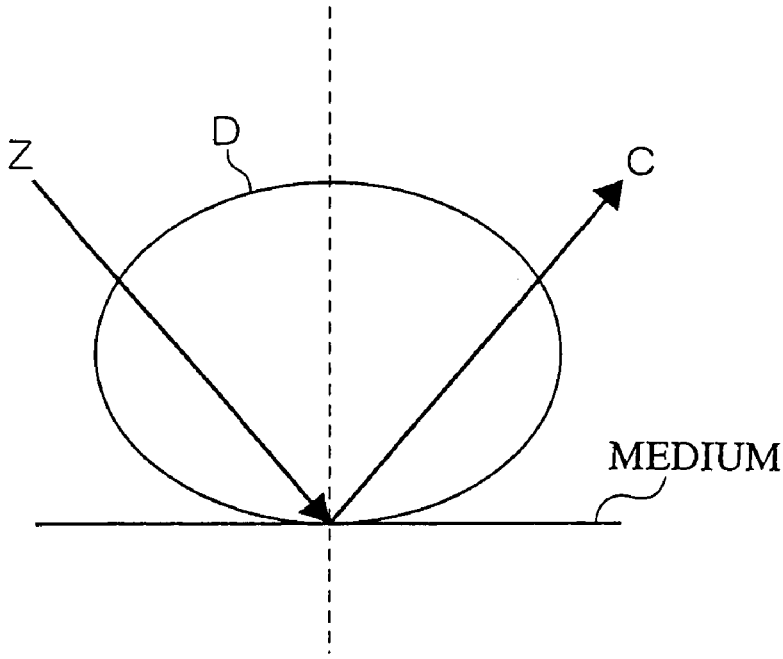
FIG. 8A is a graph showing spectral reflection characteristics of a planographic printing plate and a slip sheet.
Figure 8B:
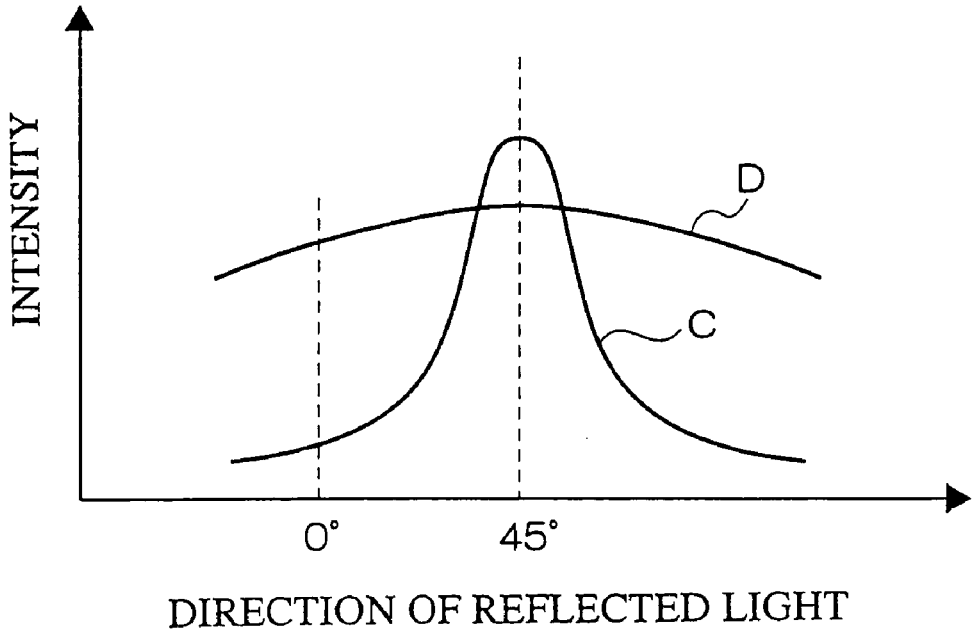
FIG. 8B is a graph showing relationships between directions of light reflected from conveyed mediums and intensities of the reflected light amounts.

FIG. 8A shows spectral reflection characteristics of the planographic printing plates 20 and the slip sheets 22. FIG. 8B shows relationships between directions of light reflected from conveyed mediums and intensities of the reflected light amounts. In FIG. 8A, Z represents a direction of incident light, C represents a direction of light reflected from the planographic printing plate 20, and D represents directions of light reflected from the slip sheet 22 (a range in which reflected light is comparatively strong). For the directions D of light reflected from the slip sheet 22, although a regularly reflected component of the incident light is large, there is actually no particular direction of reflection, and the light becomes 'scattered light'. Thus, as can be seen from FIG. 8B, if a direction of reflected light is 0°, a difference in intensity between reflected light C from the planographic printing plate 20 and reflected light D from the slip sheet 22 is large, and more reliable discrimination is possible. Therefore, it is preferable to dispose the discrimination sensors 80, 84, 86 and 90 with attitudes for which the angle of incidence of light onto the conveyed mediums is 45° and the angle of reflection is 0°.

Sensing information from the above-described presence/absence sensors 78, 82 and 88, the discrimination sensors 80, 84, 86 and 90, and the slip sheet detection sensor 92 is sent to an unillustrated control apparatus. The control apparatus controls respective portions of the planographic printing plate supply apparatus 12 on the basis of this information.

With the planographic printing plate supply apparatus 12 structured as described above, when the planographic printing plates 20 are to be supplied to the exposure device, first, the plate sheaf 18 is placed in the loading section 14. At this time, a rear end 18B of the plate sheaf 18 is contacted with and aligned at the rear end guide plate 34, and the side ends of the plate sheaf 18 are contacted with and aligned at the side end guide plates 32.

When the planographic printing plate supply apparatus 12 is installed to a predetermined location of an exposure device, as shown in FIG. 1, the cover 36A rotates upward and a portion of the plate sheaf 18 (a front end portion vicinity thereof) is exposed.

In this state, the presence/absence sensor 78 detects the presence of the planographic printing plates 20 and the slip sheets 22 in the loading section 14. Consequently, the holder 40 is driven by the drive unit 50 and, as shown in FIG. 4A, the pick-up roller 42 makes contact with the plate sheaf 18.

Here, the load W acting on the plate sheaf 18 from the pick-up roller 42 is adjusted for a case of individual feeding of the topmost planographic printing plate 20A alone or a case of joint feeding of the topmost planographic printing plate 20A and the topmost slip sheet 22A as a combination (in other words, the layer combination 24A, serving as a unit). Accordingly, it is possible to arbitrarily switch between individual feeding and joint feeding. Below, a discrimination operation of the discrimination device 77 and splitting of the slip sheet 22 from the planographic printing plate 20 at the slip sheet separation apparatus 58 will be described, first for a case of joint feeding.

In the case of joint feeding, during conveyance, the presence/absence sensor 82 is ON, the discrimination sensor 84 is ON and the discrimination sensor 86 is OFF, as shown in table 1. Accordingly, it can be determined that the feeding is joint feeding. Hence, the conveyance roller unit 60 and the retarding roller unit 62 are rotated.

Figure 9B:
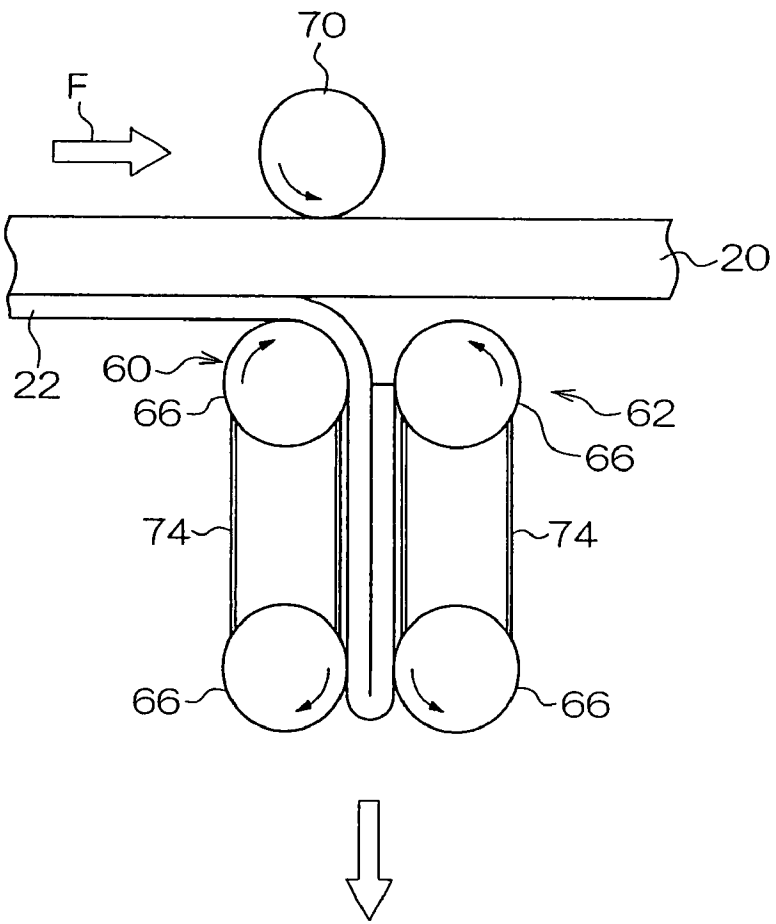
FIG. 9B is an explanatory view showing a slip sheet separation operation at the slip sheet separation apparatus, for a state in which the retarding roller unit is at a withdrawn position.
Figure 9A:
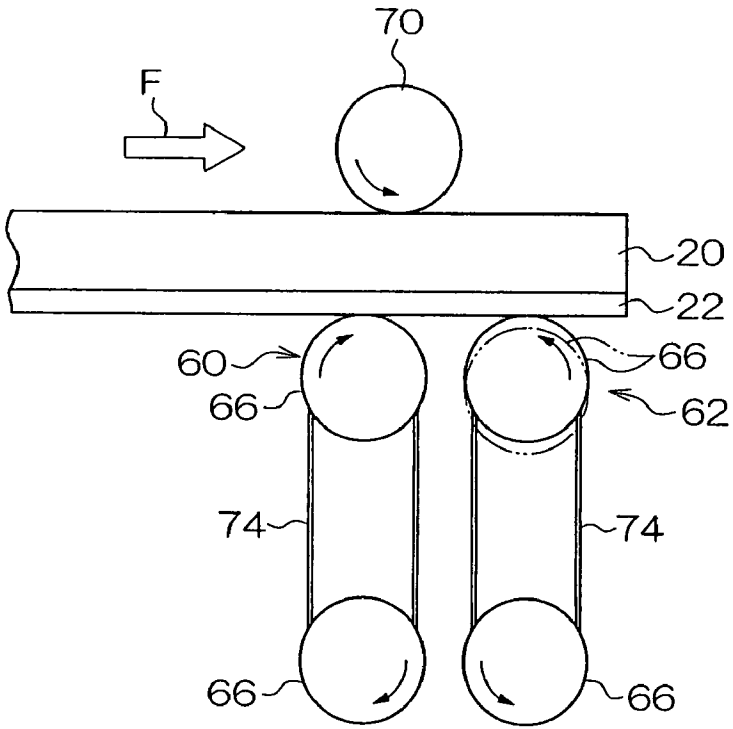
FIG. 9A is an explanatory view showing a slip sheet separation operation at a slip sheet separation apparatus of the planographic printing plate supply apparatus of the first embodiment of the present invention, for a state in which a retarding roller unit is at a contacting position.

Further, when conveyance of the planographic printing plate 20 and the slip sheet 22 in the joint feeding state is detected, by the presence/absence sensor 88 being ON and the discrimination sensor 90 being ON, the retarding roller unit 62 ascends, as shown by the solid lines in FIG. 9A. Then, the rubber rollers 66 of the retarding roller unit 62 reverse-rotate and make contact with the slip sheet 22. Hence, a force from the conveyance roller unit 60 in the conveyance direction and a force from the retarding roller unit 62 in the direction opposite to the conveyance direction act on the slip sheet 22. Thus, the slip sheet 22 can be separated from the planographic printing plate 20. Then, in a state in which the slip sheet 22 is curved at an intermediate portion thereof, the slip sheet 22 is nipped by the rubber rollers 66 of the conveyance roller unit 60 and the retarding roller unit 62 and is conveyed downward. Consequently, although the presence/absence sensor 88 stays ON, sensing the presence of the planographic printing plate 20, the discrimination sensor 90 turns OFF and it is understood that the slip sheet 22 is not present thereat, which is to say that the slip sheet 22 has been removed from the planographic printing plate 20. The slip sheet detection sensor 92 senses the passage of the slip sheet 22 and, a predetermined amount of time after passage of a trailing end of the slip sheet 22 (for example, five seconds later), the conveyance roller unit 60 and the retarding roller unit 62 stop, and the retarding roller unit 62 descends to the withdrawn position.

Subsequently, the planographic printing plate 20 from which the slip sheet 22 has been separated is detected by the presence/absence sensor 88 and the discrimination sensor 90. The planographic printing plate 20 is conveyed further and fed into the exposure device. The slip sheet 22 is collected in the collection box 76.

Figure 10:
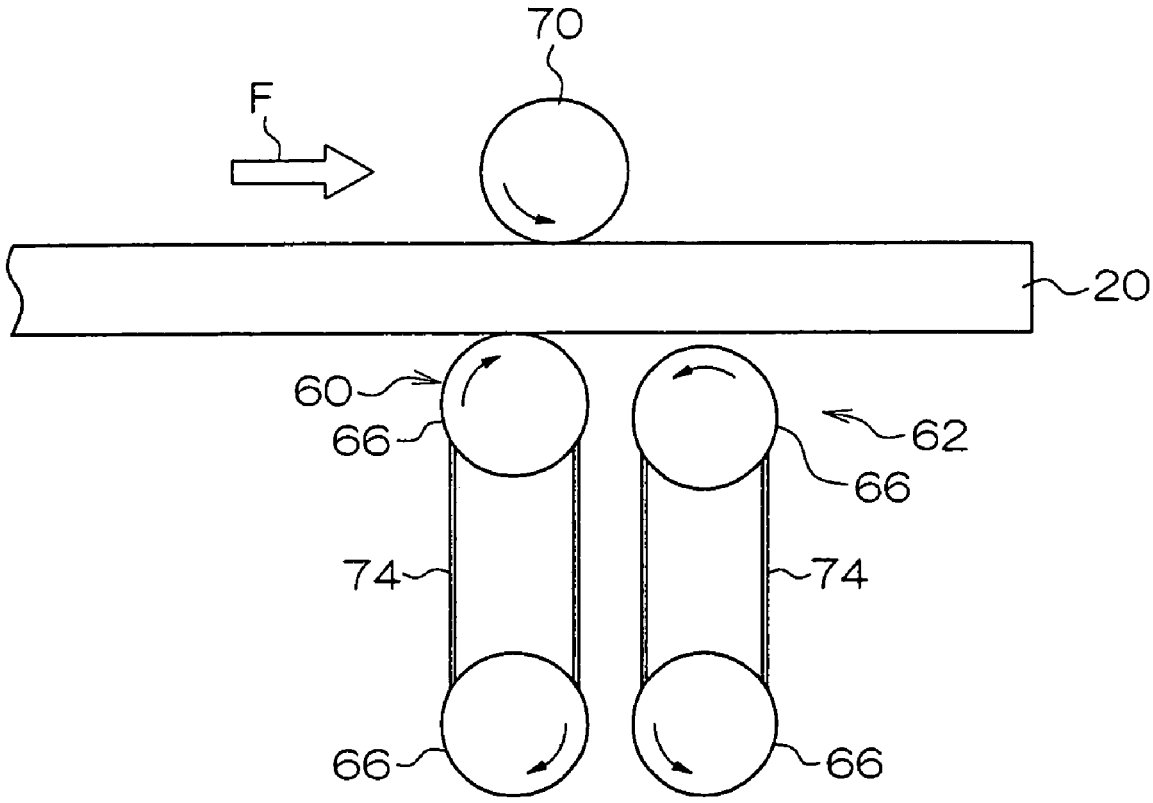
FIG. 10 is an explanatory view showing a planographic printing plate conveyance operation at the slip sheet separation apparatus of the planographic printing plate supply apparatus of the first embodiment of the present invention.

In contrast, in a case in which the planographic printing plate 20 alone is individually fed, only the presence/absence sensor 82 is ON, while the discrimination sensors 84 and 86 are both OFF. Thus, individual feeding of the planographic printing plate 20 is reliably detected. In accordance with this detection result, with the rubber rollers 66 of the retarding roller unit 62 reverse-rotating, the retarding roller unit 62 is kept at the withdrawn position, as shown in FIG. 10. Therefore, the rubber rollers 66 of the retarding roller unit 62 do not make contact with the planographic printing plate 20, the planographic printing plate 20 is conveyed as it is, and the planographic printing plate 20 is fed to the exposure device.

Figure 11B:
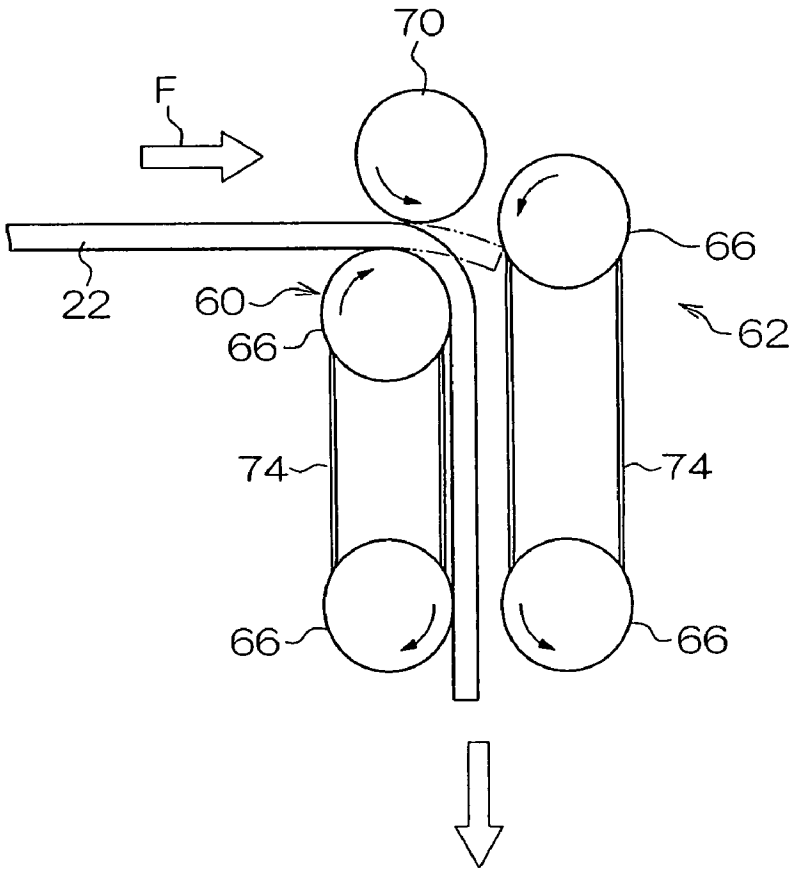
FIG. 11B is an explanatory view showing the slip sheet conveyance direction-switching operation at the slip sheet separation apparatus, for a state in which a conveyance direction of the slip sheet has been switched.
Figure 11A:
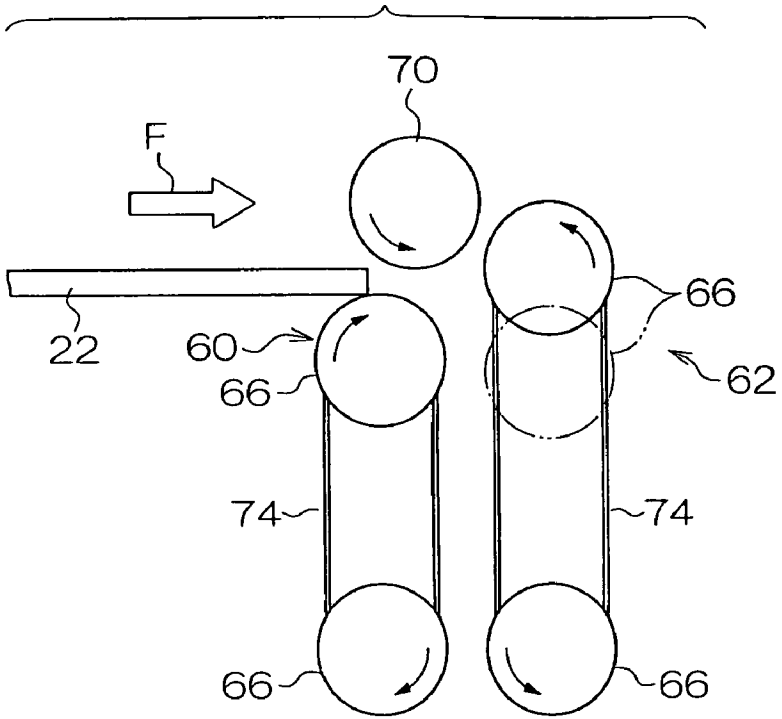
FIG. 11A is an explanatory view showing a slip sheet conveyance direction-switching operation at the slip sheet separation apparatus of the planographic printing plate supply apparatus of the first embodiment of the present invention, for a state in which a slip sheet is being conveyed.

Further, in a case in which the slip sheet 22 alone is individually fed, the presence/absence sensor 82, the discrimination sensor 84 and the discrimination sensor 86 are ON, and individual feeding of the slip sheet 22 is reliably detected. In accordance with this detection result, with the rubber rollers 66 of the retarding roller unit 62 reverse-rotating, the retarding roller unit 62 ascends to the contacting position before a leading end of the slip sheet 22 reaches that location, as shown in FIG. 11A. Then, because the rubber rollers 66 of the retarding roller unit 62 have been moved into a conveyance path of the slip sheet 22, the leading end of the conveyed slip sheet 22 meets the rubber rollers 66 and the slip sheet 22 is guided downward, as shown in FIG. 11B. Hence, the slip sheet 22 is nipped by the rubber rollers 66 of the conveyance roller unit 60 and the retarding roller unit 62 and is conveyed downward. A predetermined amount of time after the slip sheet detection sensor 92 has detected passage of the trailing end of the slip sheet 22, the conveyance roller unit 60 and the retarding roller unit 62 stop, and the retarding roller unit 62 descends as far as the withdrawn position.

As has been explained above, with the present invention it is possible to reliably discriminate between four conveyance configurations of conveyed mediums by providing three light sensors—the presence/absence sensor 82, the discrimination sensor 84 and the discrimination sensor 86—to serve as the discrimination device 77. Moreover, these three optical sensors are sufficient for this discrimination and there is no need to provide further members. Thus, structure is simple.

What is claimed is:

1. A discrimination device for discriminating a type, from two types which differ in surface reflectivity, of a discrimination subject, the discrimination device comprising:

a first optical sensor, the output of which switches to one of an ON state and an OFF state in accordance with presence of at least one of the two types of discrimination subject;

a second optical sensor including a light detection portion which receives light reflected by the two types of discrimination subject, the output of the second optical sensor switching to one of an ON state and an OFF state in accordance with light reflected from, of the two types of discrimination subject, the type whose reflectivity is higher; and a third optical sensor including a light detection portion which receives light reflected by the two types of discrimination subject, the output of the third optical sensor switching to one of an ON state and an OFF state in accordance with light reflected from, of the two types of discrimination subject, the type whose reflectivity is lower.

2. The discrimination device of claim 1, wherein the first optical sensor comprises a light emission portion, which irradiates light to the discrimination subject, and a reflected light detection portion, on which reflected light that has been emitted by the light emission portion and reflected at a surface of the discrimination subject is incident.

3. The discrimination device of claim 1, wherein at least one of the second optical sensor and the third optical sensor comprises a light emission portion, which irradiates light to the discrimination subject, and a scattered light detection portion, on which some of scattered light that has been scattered at a surface of the discrimination subject is incident.

4. The discrimination device of claim 1, wherein the discrimination subject includes a planographic printing plate and a slip sheet which has been superposed with the planographic printing plate, the output of the first optical sensor switches to the one of the ON state and the OFF state thereof in accordance with presence of at least one of the planographic printing plate and the slip sheet, the output of the second optical sensor switches to the one of the ON state and the OFF state thereof in accordance with light reflected from the planographic printing plate, and the output of the third optical sensor switches to the one of the ON state and the OFF state thereof in accordance with light reflected from the slip sheet.

5. The discrimination device of claim 3, wherein the light emission portion of the at least one of the second optical sensor and the third optical sensor is capable of emitting light with a wavelength from 570 nm to 740 nm.

6. A discrimination device for discriminating a type and configuration of a subject, the discrimination device comprising:

a first optical sensor, an output state of which switches in accordance with presence or absence of the subject;

a second optical sensor including a light detection portion which receives light reflected from the subject, an output state of the second sensor switching in accordance with the light reflected from the subject if reflectivity of the subject is relatively high; and a third optical sensor including a light detection portion which receives light reflected from the subject, an output state of the third sensor switching in accordance with the light reflected from the subject if reflectivity of the subject is relatively low, wherein the type and configuration of the subject is discriminated on the basis of the output states of the first, second and third sensors.

7. The discrimination device of claim 6, wherein the first sensor comprises a light emission portion, which irradiates light to the subject, and a light detection portion, on which reflected light that has been emitted by the light emission portion and reflected at a surface of the subject is incident.

8. The discrimination device of claim 6, wherein at least one of the second optical sensor and the third optical sensor comprises a light emission portion, which irradiates light to the subject, and a light detection portion, on which some of scattered light that has been scattered at a surface of the subject is incident.

9. The discrimination device of claim 6, wherein the subject includes a planographic printing plate and a slip sheet which is employed by being superposed with the planographic printing plate.

10. The discrimination device of claim 9, wherein the output state of the first optical sensor switches in accordance with presence of at least one of the planographic printing plate and the slip sheet.

11. The discrimination device of claim 9, wherein the output state of the second optical sensor switches in accordance with light reflected from the planographic printing plate.

12. The discrimination device of claim 9, wherein the output state of the third optical sensor switches in accordance with light reflected from the slip sheet.

13. The discrimination device of claim 8, wherein the light emission portion of the at least one of the second optical sensor and the third optical sensor is capable of emitting light with a wavelength from 570 nm to 740 nm.

14. The device of claim 6, wherein the output state of the first optical sensor switches to one of an ON state and an OFF state in accordance with presence or absence of the subject, the output state of the second optical sensor switches to one of an ON state and an OFF state in accordance with the light reflected from the subject if reflectivity of the subject is relatively high, and the output state of the third optical sensor switches to one of an ON state and an OFF state in accordance with the light reflected from the subject if reflectivity of the subject is low.

15. A discrimination device for discriminating a conveyance configuration of a sheet which is conveyed along a path, the discrimination device comprising:

a first sensor, an output state of which switches in accordance with presence or absence of the sheet in the path;

a second sensor disposed at a side of one face of the sheet that is conveyed along the path, the second sensor including a light detection portion which receives light reflected from the sheet, and an output state of the second sensor switching in accordance with the light reflected from the sheet if reflectivity of the sheet is relatively high; and a third sensor disposed at a side of another face of the sheet that is conveyed along the path, the third sensor including a light detection portion which receives light reflected from the sheet, and an output state of the third sensor switching in accordance with the light reflected from the sheet if reflectivity of the sheet is relatively low, wherein the conveyance configuration of the sheet is discriminated on the basis of the output states of the first, second and third sensors.

16. The discrimination device of claim 15, wherein the first sensor comprises a light emission portion, which irradiates light to the sheet, and a light detection portion, on which reflected light that has been emitted by the light emission portion and reflected at a surface of the sheet is incident.

17. The discrimination device of claim 16, wherein at least one of the second sensor and the third sensor comprises a light emission portion, which irradiates light to the sheet, and a light detection portion, on which some of scattered light that has been scattered at a surface of the sheet is incident.

18. The discrimination device of claim 15, wherein the sheet includes a planographic printing plate and a slip sheet which is employed by being superposed with the planographic printing plate.

19. The discrimination device of claim 15, wherein the output state of the first sensor switches in accordance with presence of at least one of the planographic printing plate and the slip sheet.

20. The discrimination device of claim 15, wherein the output state of the second sensor switches in accordance with light reflected from the planographic printing plate, and the output state of the third sensor switches in accordance with light reflected from the slip sheet.

21. The discrimination device of claim 17, wherein the light emission portion of the at least one of the second sensor and the third sensor is capable of emitting light with a wavelength from 570 nm to 740 nm.

22. The device of claim 15, wherein the output state of the first sensor switches to one of an ON state and an OFF state in accordance with presence or absence of the sheet in the path, the output state of the second sensor switches to one of an ON state and an OFF state in accordance with the light reflected from the sheet if reflectivity of the sheet is relatively high, and the output state of the third sensor switches to one of an ON state and an OFF state in accordance with the light reflected from the sheet if reflectivity of the sheet is low.

* * * * *